US008317568B2

(12) United States Patent
He

(10) Patent No.: US 8,317,568 B2
(45) Date of Patent: Nov. 27, 2012

(54) MARK-FREE WIRE FABRIC STRAPS

(75) Inventor: Mike He, Guangdong (CN)

(73) Assignee: New Horizon Elastic Fabric Co., Ltd, Dongguan, Guangdong (CN)

( * ) Notice: Subject to any disclaimer, the term of this patent is extended or adjusted under 35 U.S.C. 154(b) by 267 days.

(21) Appl. No.: 12/845,964

(22) Filed: Jul. 29, 2010

(65) Prior Publication Data

US 2011/0104986 A1 May 5, 2011

Related U.S. Application Data

(60) Provisional application No. 61/229,349, filed on Jul. 29, 2009.

(51) Int. Cl.
*A41C 3/00* (2006.01)

(52) U.S. Cl. ..... 450/41; 450/43; 450/49

(58) Field of Classification Search ..... 66/169 R, 66/170, 171; 450/49, 41, 43, 92, 93
See application file for complete search history.

(56) References Cited

U.S. PATENT DOCUMENTS

| | | | | |
|---|---|---|---|---|
| 5,669,247 | A * | 9/1997 | McCartney et al. | 66/195 |
| 6,071,578 | A * | 6/2000 | Richardson et al. | 428/36.3 |
| 6,082,145 | A * | 7/2000 | Lonati et al. | 66/176 |
| 7,611,999 | B2 * | 11/2009 | McMurray | 442/304 |
| 7,690,225 | B2 * | 4/2010 | Relats et al. | 66/170 |
| 7,757,517 | B2 * | 7/2010 | Malloy | 66/170 |
| 7,823,420 | B2 * | 11/2010 | Andrieu et al. | 66/170 |
| 7,849,715 | B2 * | 12/2010 | Starbuck et al. | 66/171 |

* cited by examiner

*Primary Examiner* — Gloria Hale
(74) *Attorney, Agent, or Firm* — George G. Wang; Bei & Ocean

(57) ABSTRACT

A mark-free fabric strap wire casing. The casing is provided with a cushion B which is composed of erect fine hairs C for relieving the stress generated by the bra wire on skin. With simple structure, the present invention which is used as the casing for the wire used in female underwear can be manufactured with high production efficiency and suitable for the production automation. Because the fabric strap itself is provided with a cushion composed of erect fine hairs, it has a softer feel when in contact with skin and relieves the pressure feel generated by the wire within the underwear on skin. It reduces the wire impression mark left under the breasts after wearing it. The wire can be embedded without causing much embossment, thereby enchaining visual appearance of the underwear article.

5 Claims, 11 Drawing Sheets

▲ = Nylon yarn (model No. 1)

◆ = Nylon yarn (model No. 2)

X = Nylon yarn (model No. 3)

※ = Nylon yarn (model No. 4)

O = Spandex yarn

◆ : Only pass through the upper holes of frames 8, 9, 10 and 11;

※ : Only pass through the lower holes of frames 13 and 15.

MARK-FREE WIRE FABRIC STRAPS

CROSS REFERENCE

This application claims benefit from U.S. Provisional Application No. 61/229,349, filed Jul. 29, 2009. the content of which is incorporated herewith in its entirety.

FIELD OF THE INVENTION

The present invention relates to the field of making fabric straps, more specifically, it relates to a mark-free fabric strap used as a wire casing.

BACKGROUND OF THE INVENTION

As an important article to maintain female breast shape, the bra can provide young women with a properly shaped containment for developing the breasts into a desirable shape and avoid sagging, and for mature women with already fully developed breasts it can help them to maintain a firm chest shape and cleavage. Therefore, it has always been an important necessity for women over the years. However, presently the wire used in the bra is wrapped with a casing having double layers of the same thickness. After the bra wire being embedded in the casing, it will form significant embossment which, with an unpleasant coarse hand feel, can cause an uncomfortably pressing feel when coming in contact with the skin.

SUMMARY OF THE INVENTION

To overcome the above-mentioned problems, a fabric strap is provided by the present invention, which can be used as a wire casing and does not causing significant pressing feel on the skin. With its simple structure, it can be manufactured with high production efficiency and suitable for industrial automation.

For attaining the above-mentioned technical effects, the present invention adopts the following technical scheme: A mark-free fabric strap (i.e., a strap which leaves no impressing mark on the skin) is provided with a cushion layer for relieving the pressure generated by the bra wire on the skin. It is characterized as follows:

In the thickness direction of the fabric strap, a cushion is formed by a layer of erect fine filaments interwoven with and connecting between the middle and lower layers of the fabric strap.

The structure of the fabric strap is a three-layer weave structure and it uses a three-hole heddle as shown in FIG. 10 and FIG. 11.

The resistance to punctuation of the cushioned side is equal to or greater than 25 kgf.

The surface of the wire fabric strap can be napped or unnapped.

The cushioned side is thicker than the other non-cushioned side.

The fabric strap is an integrally woven tubular structure.

Said fabric strap is elastic or non-elastic.

The fabric strap adopts a nap warp raising weave structure to form erect fine filaments. The height of the filaments ranges from 0.5 mm to 3.0 mm.

With the simple structure, it can be manufactured with high production efficiency and suitable for production automation. The resulting fabric strap is ideal as casings for wires used for maintaining female chest shape. Because of the cushion layer, after the wire is embedded in the fabric strap, it does not form a significant embossment (i.e., a raised tubular shape), thereby being more visibly appealing and with a pleasant hand feel. It reduces the pressure caused on the skin when coming in contact with thereof, enchaining the conformable feel to the wearer. In the meantime, the casing has a much improved strength against penetration by the wire, and thus is not prone to be punctured by the bra wire and causing injuries to the wearer. Therefore, the mark-free wire fabric strap of the present invention when used as casings can not only enhance the wire's function but also overcome its problems, such as, leaving pressure marks under the breasts. Thus, whether the wearer is stationary or in motion, the casing can bring about a conformable feel and a pleasant visual appearance.

DETAILED DESCRIPTION OF PARTICULAR EMBODIMENTS OF THE INVENTION

The following is a further description of an embodiment of the present invention with reference to the attached figures.

Figure 1:
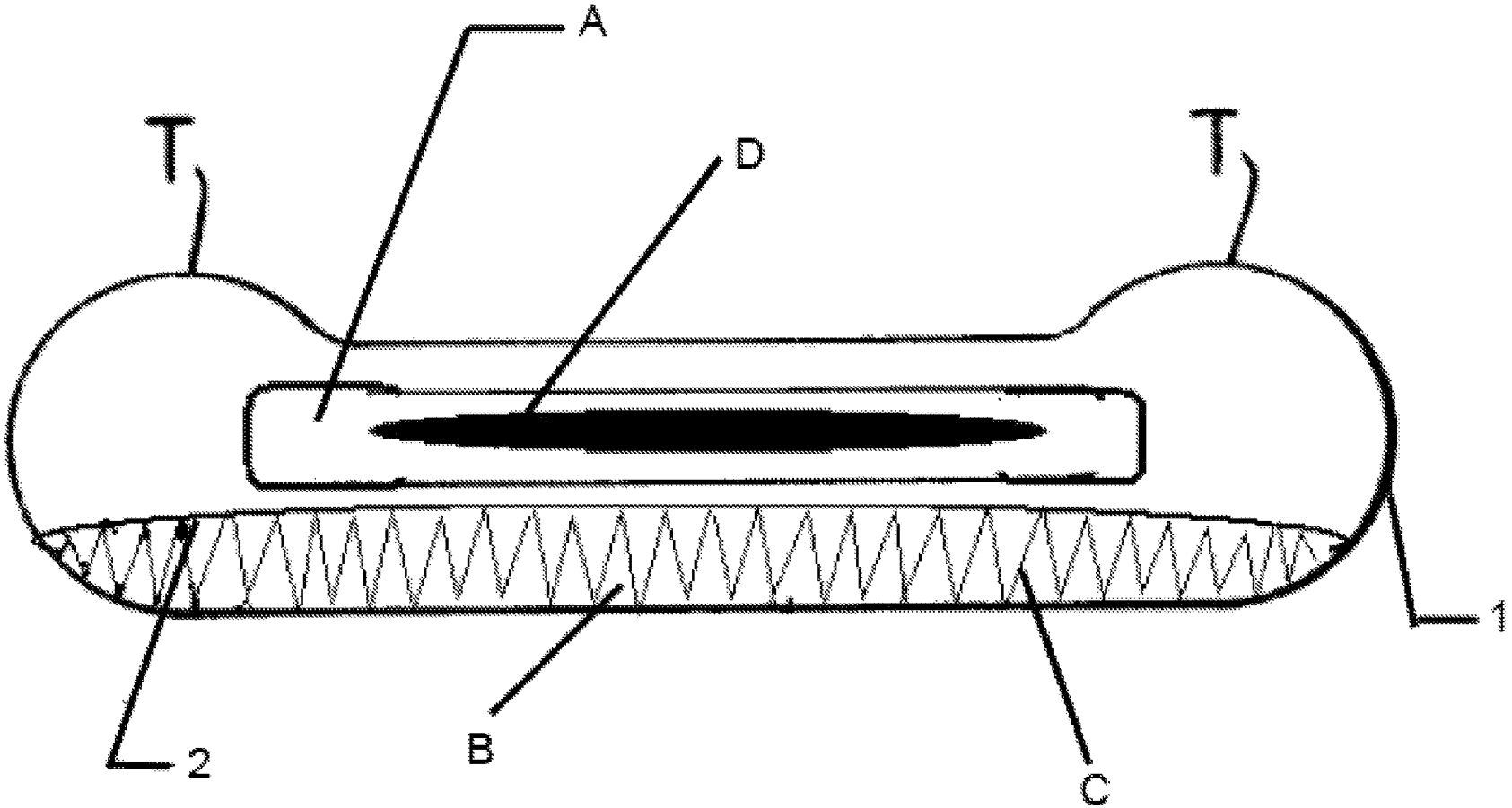
FIG. 1 shows a cross sectional view of the mark-free fabric strap casing according to the present invention (with the wire being embedded therein)
Figure 2:
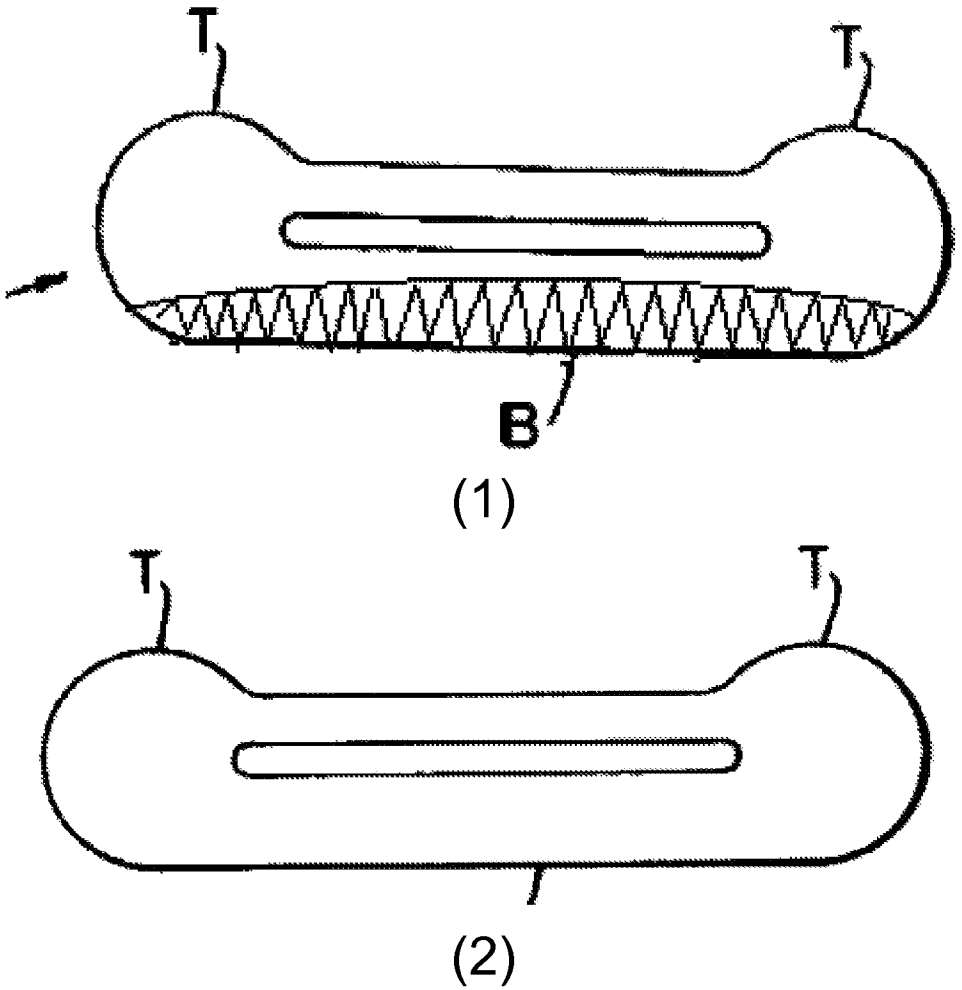
FIG. 2 shows a comparison between the fabric strap casing of the present invention (FIG. 2-1) and a conventional casing (FIG. 2-2)

The invention relates to a mark-free fabric strap wire casing, which has a cushion layer. As shown in FIG. 1, the fabric strap itself is an integrally woven tubular structure including a woven integral outer wrapping layer 1, inner layer 2, channel A, cushion layer B and naps C (i.e., fine filaments) of the cushion layer.

Figure 3:
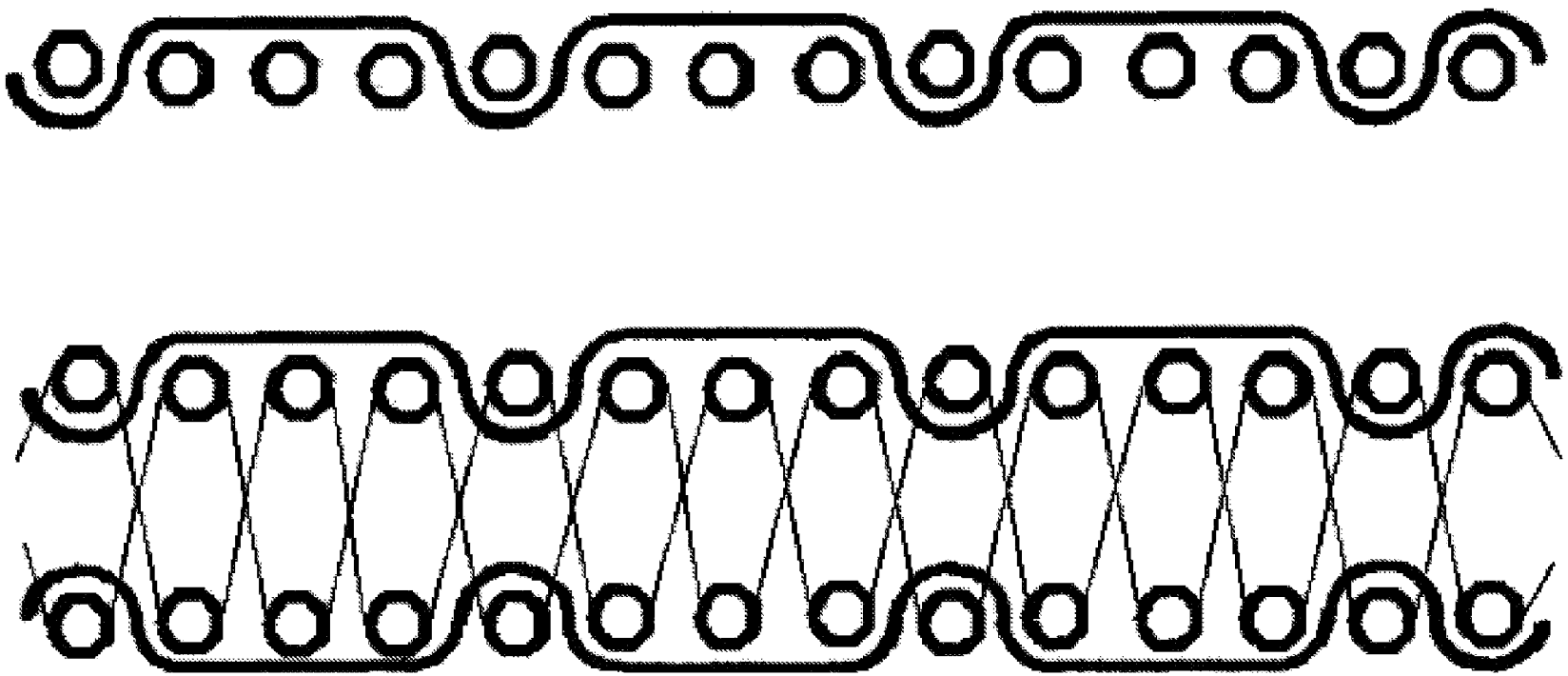
FIG. 3 shows the lengthwise fabric structure sketch of the fabric strap casing according to the present invention.
Figure 7:
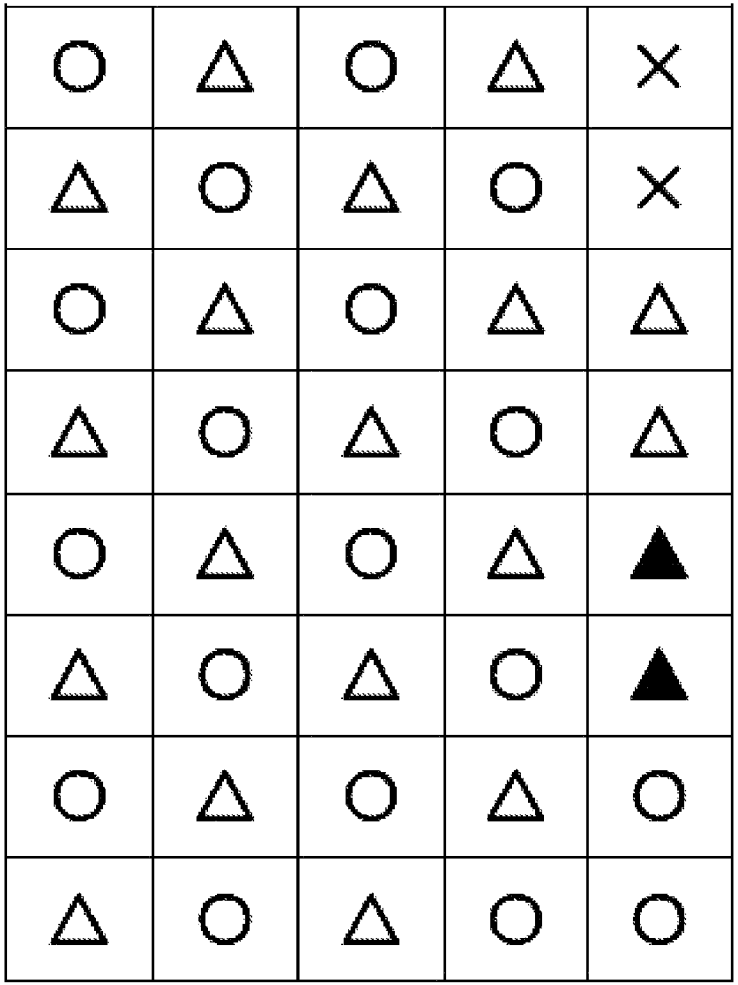
FIG. 7 shows the lower-layer weave structure diagram of the fabric strap casing according to the present invention shown in FIG. 4.
Figure 8:
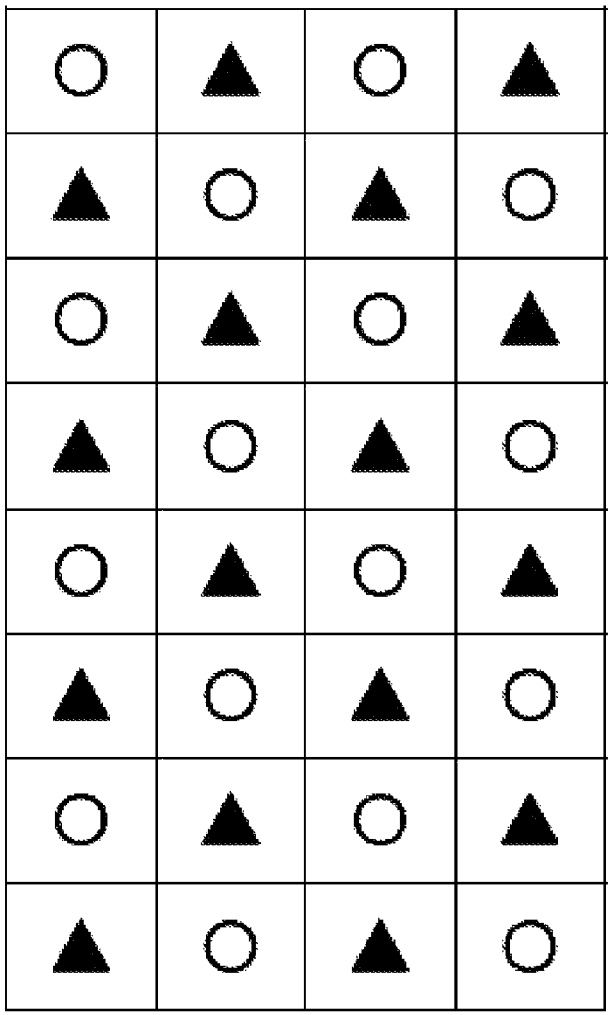
FIG. 8 shows the nap warp weave structure diagram of the fabric strap casing according to the present invention shown in FIG. 4.

As shown in FIG. 3, the mark-free wire fabric strap of the present invention is a three-layer fabric. When the three-layer fabric is woven, the warps need to be divided into four layers of yarns. Being arranged from high to bottom, these warps are kept in the highest position, sub-high position, sub-low position and the lowest position, respectively. Among the three layers of the fabric, the upper-layer is interwoven by upper-layer wefts and upper-layer warps, referring to FIG. 5 for detailed weave structure; the middle-layer is interwoven by middle-layer wefts and middle-layer warps, referring to FIG. 6 for detailed weave structure; the lower-layer is interwoven by lower-layer wefts and lower-layer warps, referring to FIG. 7 for detailed weave structure. The middle-layer and lower-layer are connected by nap warps and the weave structure diagram of the nap warps is shown in FIG. 8.

Figure 5:
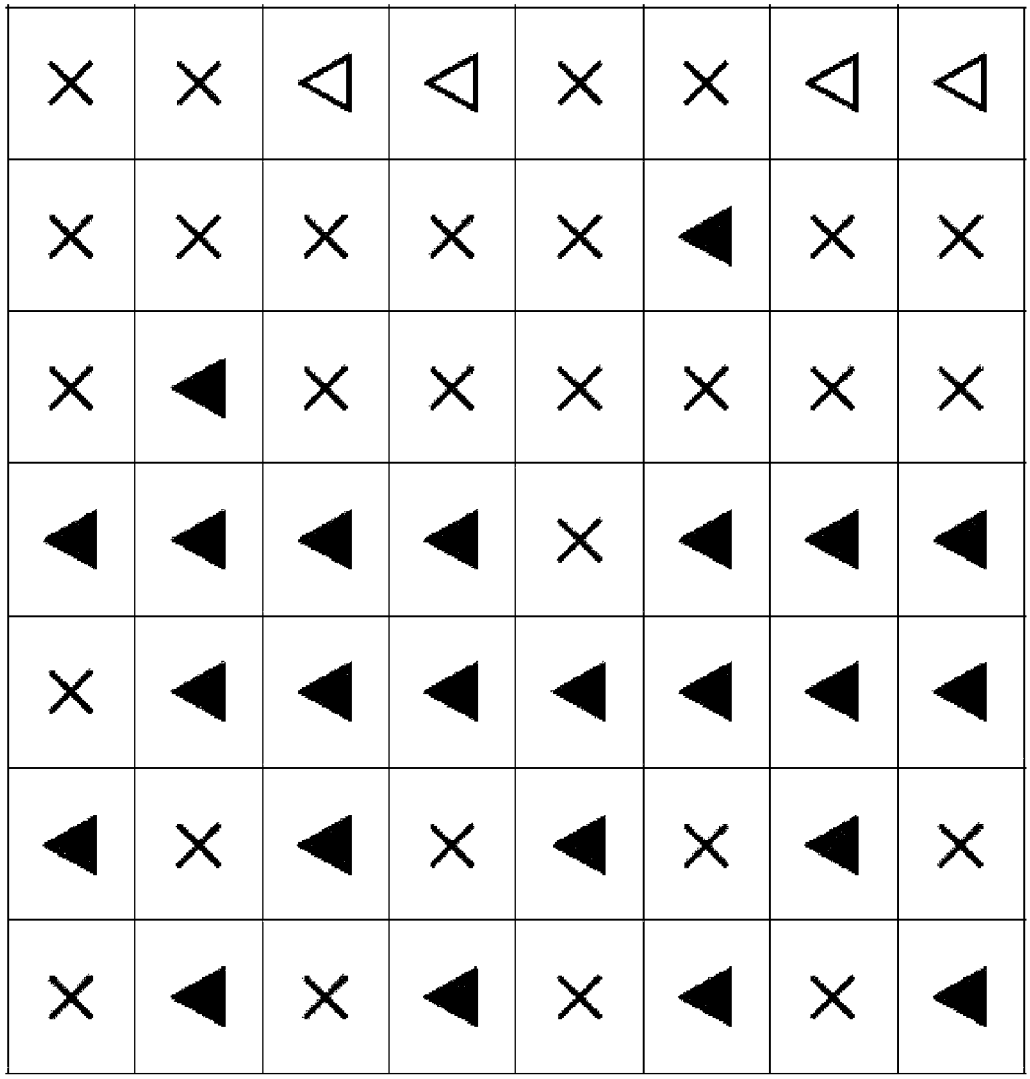
FIG. 5 shows the upper-layer weave structure diagram of the fabric strap casing according to the present invention shown in FIG. 4.
Figure 6:
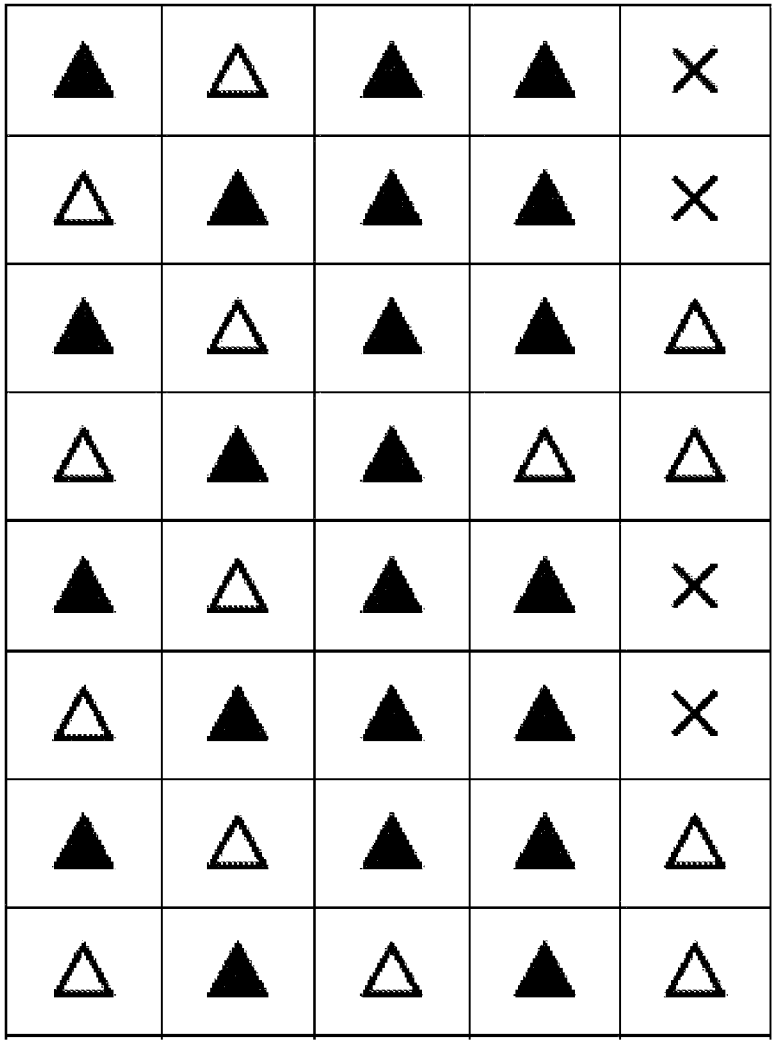
FIG. 6 shows the middle-layer weave structure diagram of the fabric strap casing according to the present invention shown in FIG. 4.

As shown in FIG. 5 and FIG. 6, there is a weave structure connecting the upper-layer and middle-layer at both sides, so that a hollow tubing fabric for encasing the bra wire is formed. Similarly as the upper-layer is connected with the middle-layer as shown in FIG. 7, there is a weave structure connecting the middle layer and the lower layer at both sides, where the middle-layer and lower-layer are interwoven by nap warps as shown in FIG. 8, resulting in erect fine filaments from which a cushion is formed. For the present invention, the nap filament height can be adjusted within a certain range, preferable, between 0.5 mm-3 mm.

Preferred weave structures of the upper layer, middle layer and lower layer of the wire fabric strap casing of the present invention are shown in FIG. 5, FIG. 6 and FIG. 7, respectively, but their weave structures are not limited to those shown in the figures. A preferred weave structure of the nap warps is shown in FIG. 8 but the structure is not limited to the one shown in FIG. 8. The meanings of the symbols used in figures are as follows. x indicates that the warps kept in the highest position, ▲ indicates that the warps kept in the sub-high position, Δ indicates that the warps kept in the sub-low position and ○ indicates that the warps kept in the lowest position.

The wire fabric strap casing of the present invention may use Polyamide, Spandex, Polyester and other raw materials. For example, the nap of the wire fabric strap casing is preferably of Polyamide, such as Polyamide 6 or Polyamide 66.

Figure 9:
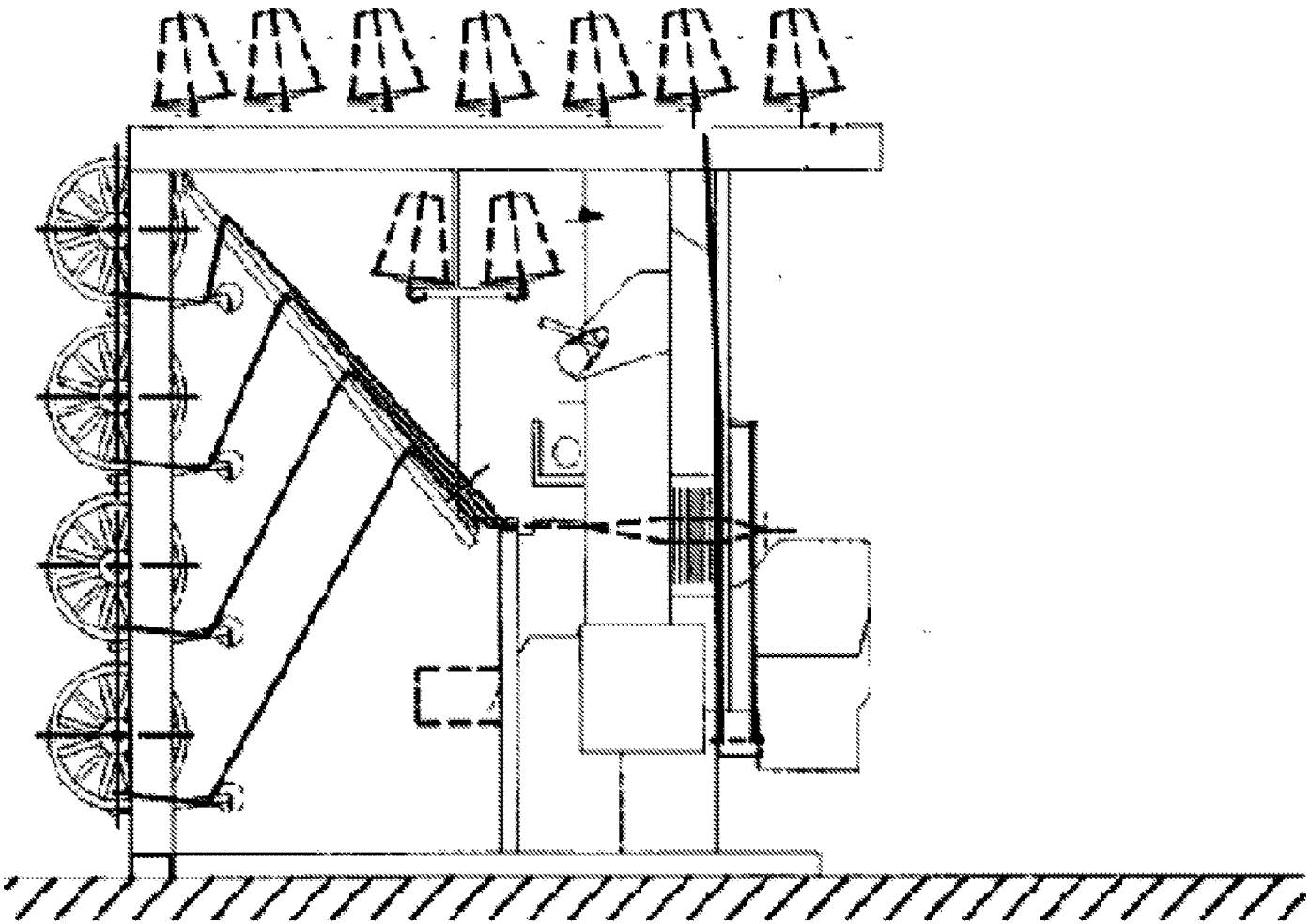
FIG. 9 shows the structural diagram of the manufacturing equipment for making the fabric strap casing according to the present invention.

The main manufacturing equipment for practicing the invention is a shuttleless loom as shown in FIG. 9.

Figure 4:
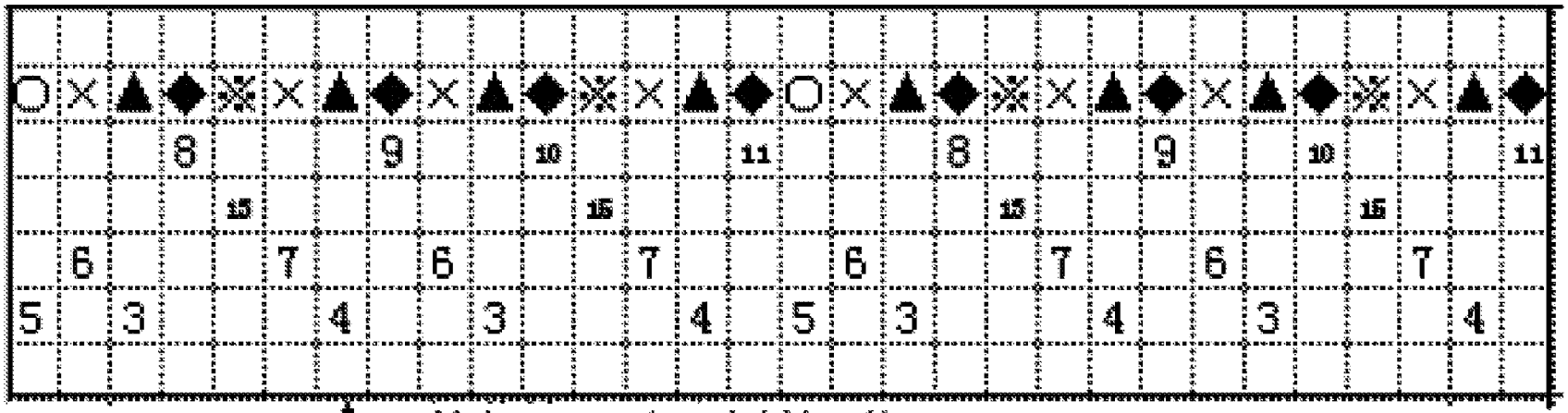
FIG. 4 shows the partial warp arrangement diagram of the fabric strap casing according to the present invention.

The manufacturing process of the fabric strap casing is described in the following:

1. Wind the required warps (spandex yarn, nylon yarn and other yarns) on the pan head;

2. Wind and convey warps through the warp pan head and make thread in the warp pass through the heddle of shuttleless loom according to warp arrangement diagram shown in FIG. 4, where "x" indicates upper, middle and lower layers-warps, "◆" indicates upper-layer warps, "X" indicates lower-layer warps and "▲" indicates nap warps.

3. The heald frame moves up and down in accordance with weave diagrams shown in FIG. 5, FIG. 6 and FIG. 7, thereby driving the up-and-down motion of heddles and dividing the warps into four layers to form an opening.

Figure 10:
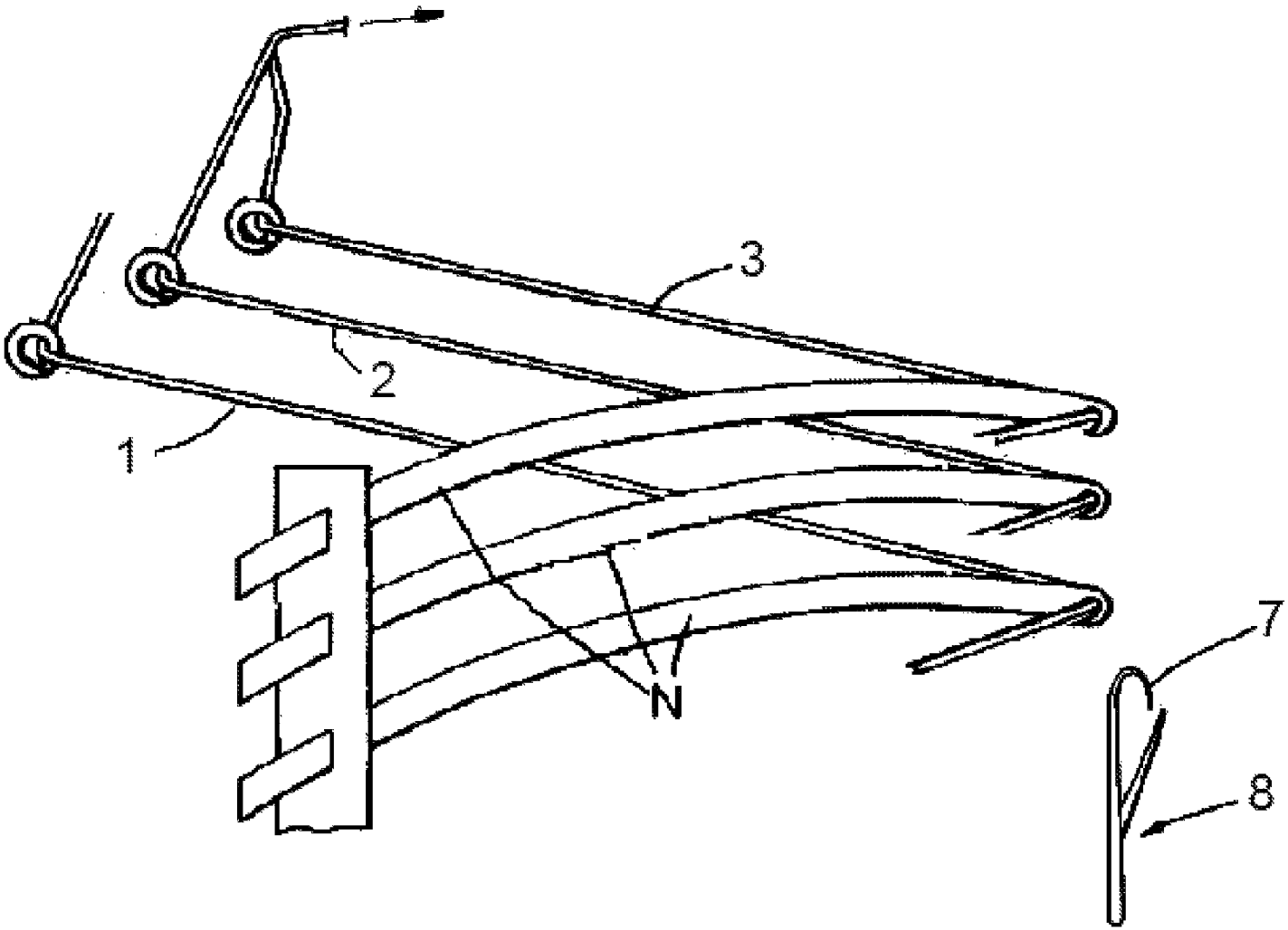
FIG. 10 shows the three-weft structure diagram.
Figure 11:
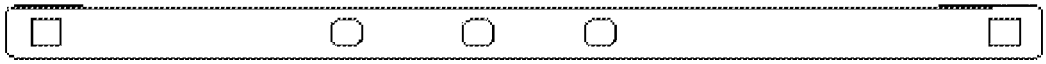
FIG. 11 shows the schematic diagram of a three-hole heddle.

4. The three-weft hook drives wefts to traverse the opening and the latch needle winds up the wefts or edges as shown in FIG. 10;

5. The loom reed swings to make wefts passing through the opening firm and form a fabric strap.

The present invention fabric strap casing can be an elastic fabric strap or a non-elastic fabric strap. In case raw materials with a high elasticity coefficient are used as the raw materials, an elastic fabric strap can be woven; in case raw materials with an elasticity coefficient close to zero, the resulting fabric strap will be a non-elastic type.

What is claimed is:

1. A cushioned fabric underwire casing, comprising an upper layer, a middle layer, and a lower layer, wherein said three layers are each made of interweaved warp yarns and weft yarns, said upper layer and middle layer are interconnected at both longitudinal sides resulting in a hollow tubular fabric and a plurality of warp yarns form fine filaments connected to and interweaved with both said middle layer and lower layer resulting in a cushion.

2. The cushioned fabric underwire casing of claim 1, having a punctuation resistance equal to or greater than 25 kgf.

3. The cushioned fabric underwire casing of claim 1, wherein any one surface of the fabric underwire casing is napped or not napped.

4. The cushioned fabric underwire wire casing of claim 1, being an integrally woven tubular structure.

5. The cushioned fabric underwire wire casing of claim 1, wherein, the underwire casing includes one of elastic yarns to form an elastic fabric casing or with non-elastic yarns to form a non-elastic fabric casing.

* * * * *